US008726606B2

(12) United States Patent
Strickland et al.

(10) Patent No.: US 8,726,606 B2
(45) Date of Patent: May 20, 2014

(54) LIGHT STEEL TRUSSES AND TRUSS SYSTEMS

(75) Inventors: Michael R. Strickland, Richmond Hill, CA (US); Douglas M. Fox, Kitchener, CA (US); Richard Wilson Strickland, Richmond Hill, CA (US)

(73) Assignee: Paradigm Focus Product Development Inc., Richmond Hill, ON (CA)

( * ) Notice: Subject to any disclaimer, the term of this patent is extended or adjusted under 35 U.S.C. 154(b) by 443 days.

(21) Appl. No.: 12/227,440

(22) PCT Filed: May 17, 2007

(86) PCT No.: PCT/CA2007/000870

§ 371 (c)(1),
(2), (4) Date: Mar. 23, 2009

(87) PCT Pub. No.: WO2007/134435

PCT Pub. Date: Nov. 29, 2007

(65) Prior Publication Data

US 2009/0308016 A1 Dec. 17, 2009

Related U.S. Application Data

(60) Provisional application No. 60/801,054, filed on May 18, 2006.

(51) Int. Cl.

| | |
|---|---|
| ***E04B 1/18*** | (2006.01) |
| ***E04B 5/10*** | (2006.01) |
| ***E04B 5/18*** | (2006.01) |
| ***E04C 3/02*** | (2006.01) |

(52) U.S. Cl.
USPC ..... 52/636; 52/639

(58) Field of Classification Search
USPC ..... 52/241, 242, 479, 481.1, 633, 634, 636, 52/637, 638, 639, 650.2, 690, 693, 831, 52/837, 645
See application file for complete search history.

(56) References Cited

U.S. PATENT DOCUMENTS

| | | | |
|---|---|---|---|
| 827,268 | A | 7/1906 | Stieper |
| 1,360,720 | A | 11/1920 | Brown et al. |

(Continued)

FOREIGN PATENT DOCUMENTS

| | | |
|---|---|---|
| AU | 47479/79 | 12/1980 |
| AU | 540590 | 1/1985 |

(Continued)

OTHER PUBLICATIONS

International Search Report for PCT/CA2010/001750, mailed Feb. 21, 2011.

(Continued)

*Primary Examiner* — William Gilbert
*Assistant Examiner* — Theodore Adamos
(74) *Attorney, Agent, or Firm* — Hill & Schumacher

(57) ABSTRACT

A truss chord for use in a light steel truss includes a flange portion, a pair of web portions and at least one wing. The flange portion has an end and an end portion. The end portion has a double thickness. The pair of web portions extend substantially orthogonally from the flange portion and are spaced inwardly from the ends of the flange portion. The at least one wing extends outwardly substantially orthogonally from at least one of the pair of web portions. There is provided an alternate embodiment wherein the wing having a plurality of spaced apart holes formed therein. There is also provided a truss web. As well there is a truss which uses the truss chords and truss webs and a truss system which uses a plurality of trusses. In addition there is a mass customization system for the trusses.

7 Claims, 21 Drawing Sheets

(56) References Cited

U.S. PATENT DOCUMENTS

| | | | | |
|---|---|---|---|---|
| 1,622,559 | A | | 3/1927 | Zabriskie |
| 1,915,424 | A | | 6/1933 | Kerr |
| 1,918,345 | A | | 7/1933 | McHose |
| 1,974,730 | A | | 9/1934 | Zollinger |
| 1,983,632 | A | | 12/1934 | Miller |
| 2,088,781 | A | | 8/1937 | Folsom |
| 2,108,373 | A | | 2/1938 | Greulich |
| 2,169,253 | A | | 8/1939 | Kotrbaty |
| 2,194,810 | A | | 3/1940 | Reiner |
| 2,246,215 | A | | 6/1941 | Nagin et al. |
| 2,256,812 | A | | 9/1941 | Miller |
| 2,457,250 | A | | 12/1948 | Macomber |
| 2,514,607 | A | | 7/1950 | McLean |
| 2,624,430 | A | | 1/1953 | Macomber |
| 2,630,890 | A | | 3/1953 | Macomber |
| 2,630,899 | A | | 3/1953 | Macomber |
| 2,662,272 | A | | 12/1953 | Macomber |
| 2,860,743 | A | | 11/1958 | Cliff |
| 2,864,471 | A | | 12/1958 | Williams |
| 3,158,731 | A | | 11/1964 | Cape |
| 3,221,467 | A | | 12/1965 | Henkels |
| 3,288,977 | A | | 11/1966 | Keller |
| 3,349,535 | A | | 10/1967 | Balinski |
| 3,367,080 | A | | 2/1968 | McClelland |
| 3,381,439 | A | | 5/1968 | Thulin, Jr. |
| 3,483,665 | A | | 12/1969 | Miller |
| 3,487,861 | A | | 1/1970 | Fahrenbach |
| 3,503,173 | A | * | 3/1970 | Jureit ..... 52/644 |
| 3,626,567 | A | | 12/1971 | Michelson et al. |
| 3,639,962 | A | | 2/1972 | Gooder |
| 3,641,303 | A | | 2/1972 | Collins |
| 3,818,083 | A | | 6/1974 | Butts et al. |
| 3,942,297 | A | | 3/1976 | Kitagawa |
| 3,945,168 | A | | 3/1976 | Butts et al. |
| 3,945,741 | A | | 3/1976 | Wendt |
| 3,979,868 | A | | 9/1976 | Butts et al. |
| 4,041,664 | A | | 8/1977 | Davis, Jr. |
| 4,056,908 | A | | 11/1977 | McManus |
| 4,122,647 | A | | 10/1978 | Kovar |
| 4,151,694 | A | | 5/1979 | Sriberg et al. |
| 4,159,604 | A | | 7/1979 | Burrell |
| 4,189,883 | A | | 2/1980 | McManus |
| 4,207,719 | A | | 6/1980 | Knowles |
| 4,281,497 | A | | 8/1981 | Luotonen et al. |
| 4,385,476 | A | | 5/1983 | Slager |
| 4,409,771 | A | | 10/1983 | Lowe |
| 4,421,969 | A | | 12/1983 | Tanenbaum |
| 4,432,178 | A | | 2/1984 | Taft |
| 4,441,292 | A | | 4/1984 | Ericsson |
| 4,454,695 | A | | 6/1984 | Person |
| 4,476,662 | A | | 10/1984 | Fisher |
| 4,490,958 | A | | 1/1985 | Lowe |
| 4,548,014 | A | | 10/1985 | Knowles |
| 4,549,381 | A | | 10/1985 | Holtz |
| 4,560,301 | A | | 12/1985 | Gilb |
| 4,566,240 | A | | 1/1986 | Schilger |
| 4,569,177 | A | | 2/1986 | Ottinger |
| 4,592,184 | A | | 6/1986 | Person et al. |
| 4,688,358 | A | | 8/1987 | Madray |
| 4,691,494 | A | | 9/1987 | Gwynne |
| 4,702,059 | A | | 10/1987 | Holtz |
| 4,715,155 | A | | 12/1987 | Holtz |
| 4,720,957 | A | | 1/1988 | Madray |
| 4,729,201 | A | | 3/1988 | Laurus et al. |
| 4,741,138 | A | | 5/1988 | Rongoe, Jr. |
| 4,793,113 | A | | 12/1988 | Bodnar |
| 4,836,436 | A | | 6/1989 | Hannah |
| 4,837,994 | A | | 6/1989 | Stohs |
| 4,845,908 | A | | 7/1989 | Stohs |
| 4,887,406 | A | | 12/1989 | Saia |
| 4,937,997 | A | | 7/1990 | Thomas, Jr. et al. |
| 4,937,998 | A | | 7/1990 | Goldberg |
| 4,947,612 | A | | 8/1990 | Taylor et al. |
| 4,982,545 | A | | 1/1991 | Stromback |
| 4,986,051 | A | | 1/1991 | Meyer et al. |
| 5,004,369 | A | | 4/1991 | Young |
| 5,146,726 | A | | 9/1992 | Ellison, Jr. |
| 5,207,045 | A | | 5/1993 | Bodnar |
| 5,214,900 | A | | 6/1993 | Folkerts |
| 5,220,761 | A | | 6/1993 | Selby |
| 5,230,190 | A | | 7/1993 | Schuette |
| 5,240,342 | A | | 8/1993 | Kresa, Jr. |
| 5,301,486 | A | | 4/1994 | Taylor |
| 5,373,675 | A | | 12/1994 | Ellison, Jr. |
| 5,417,028 | A | | 5/1995 | Meyer |
| 5,476,704 | A | | 12/1995 | Kohler |
| 5,499,480 | A | | 3/1996 | Bass |
| 5,527,625 | A | | 6/1996 | Bodnar |
| 5,544,464 | A | | 8/1996 | Dutil |
| 5,546,716 | A | | 8/1996 | Broxterman et al. |
| 5,553,437 | A | | 9/1996 | Navon |
| 5,625,995 | A | | 5/1997 | Martin |
| 5,669,197 | A | | 9/1997 | Bodnar |
| 5,687,538 | A | | 11/1997 | Frobosilo et al. |
| 5,761,873 | A | | 6/1998 | Slater |
| 5,771,653 | A | * | 6/1998 | Dolati et al. ..... 52/846 |
| 5,842,318 | A | | 12/1998 | Bass et al. |
| 5,865,008 | A | | 2/1999 | Larson |
| 5,875,605 | A | | 3/1999 | Rudd |
| 5,881,520 | A | * | 3/1999 | Blazevic ..... 52/281 |
| 5,895,534 | A | | 4/1999 | Daley et al. |
| 5,927,036 | A | | 7/1999 | Matthews et al. |
| 5,937,608 | A | | 8/1999 | Kucirka |
| 5,941,035 | A | | 8/1999 | Purse |
| 6,073,414 | A | | 6/2000 | Garris et al. |
| 6,131,362 | A | | 10/2000 | Buecker |
| 6,170,217 | B1 | | 1/2001 | Meyer |
| 6,254,306 | B1 | | 7/2001 | Williams |
| 6,263,634 | B1 | | 7/2001 | Bodnar et al. |
| 6,301,854 | B1 | | 10/2001 | Daudet et al. |
| 6,301,857 | B1 | | 10/2001 | Vrana |
| 6,415,577 | B1 | | 7/2002 | Curtis |
| 6,418,694 | B1 | | 7/2002 | Daudet et al. |
| 6,436,552 | B1 | | 8/2002 | Walker et al. |
| 6,457,292 | B1 | | 10/2002 | Vrana |
| 6,484,464 | B1 | | 11/2002 | Ochoa |
| 6,519,908 | B1 | | 2/2003 | Masterson et al. |
| 6,571,527 | B1 | | 6/2003 | Rattini |
| 6,634,153 | B1 | | 10/2003 | Peterson |
| 6,658,809 | B2 | * | 12/2003 | Collins ..... 52/639 |
| 6,662,517 | B1 | | 12/2003 | Thompson |
| 6,708,459 | B2 | | 3/2004 | Bodnar |
| 6,761,005 | B1 | | 7/2004 | Daudet et al. |
| 6,799,406 | B2 | | 10/2004 | Gosselin et al. |
| 6,799,407 | B2 | | 10/2004 | Saldana |
| 6,843,036 | B2 | | 1/2005 | Stewart, III |
| 6,874,294 | B2 | | 4/2005 | Masterson et al. |
| 6,964,140 | B2 | | 11/2005 | Walker et al. |
| 7,086,208 | B2 | | 8/2006 | Masterson et al. |
| 7,093,401 | B2 | | 8/2006 | Collins |
| 7,107,730 | B2 | | 9/2006 | Park |
| 7,231,746 | B2 | | 6/2007 | Bodnar |
| 7,240,463 | B2 | | 7/2007 | Masterson et al. |
| 7,409,804 | B2 | | 8/2008 | Moody et al. |
| 7,546,714 | B2 | | 6/2009 | Masterson et al. |
| 2002/0020138 | A1 | | 2/2002 | Walker et al. |
| 2002/0029538 | A1 | | 3/2002 | Webb |
| 2002/0046534 | A1 | | 4/2002 | Heinly |
| 2002/0069606 | A1 | | 6/2002 | Gosselin et al. |
| 2002/0144484 | A1 | | 10/2002 | Vrana |
| 2003/0014934 | A1 | | 1/2003 | Bodnar |
| 2003/0014935 | A1 | | 1/2003 | Bodnar |
| 2003/0061780 | A1 | | 4/2003 | Masterson |
| 2003/0084637 | A1 | | 5/2003 | Daudet |
| 2005/0102962 | A1 | | 5/2005 | McInerney et al. |
| 2005/0144892 | A1 | * | 7/2005 | Strickland et al. ..... 52/729.1 |

FOREIGN PATENT DOCUMENTS

| | | |
|---|---|---|
| AU | 543398 | 1/1985 |
| AU | 14733/97 | 2/1997 |
| AU | 199952660 | 10/1999 |
| AU | 762835 | 7/2003 |
| AU | 2004100666 | 8/2004 |

(56) References Cited

FOREIGN PATENT DOCUMENTS

| | | |
|---|---|---|
| CA | 900687 | 5/1972 |
| CA | 1172463 | 8/1984 |
| CA | 2092809 | 11/2001 |
| CA | 2412726 | 11/2009 |
| CA | 2455071 | 11/2011 |
| GB | 668485 | 3/1952 |
| GB | 1447055 | 8/1976 |
| GB | 2340141 | 2/2000 |
| JP | 8338103 | 12/1996 |
| WO | 02/01016 | 1/2002 |
| WO | 03/057931 | 7/2003 |
| WO | 2005/042869 | 5/2005 |

OTHER PUBLICATIONS

International Search Report for PCT/CA2010/001405, mailed Jan. 27, 2011.

* cited by examiner

LIGHT STEEL TRUSSES AND TRUSS SYSTEMS

CROSS REFERENCE TO RELATED U.S. APPLICATIONS

This patent application is a National Phase application claiming the benefit of PCT/CA2007/000870 filed on May 17, 2007; which further claims the priority benefit from U.S. Provisional Patent Application Ser. No. 60/801,054 filed on May 18, 2006, in English, entitled "LIGHT STEEL TRUSSES", and which is incorporated herein by reference in its entirety.

FIELD OF THE INVENTION

This invention relates to trusses and in particular to trusses made from light steel.

BACKGROUND OF THE INVENTION

Trusses have been used for many years in the construction of floors and roofs in buildings. In the 1950's, the introduction of the metal truss plate replaced plywood gusset plates and allowed for off-site manufacturing and long span trusses. Light steel trusses have been developed that utilize parts that are mass-produced by means of cold forming mills.

Currently, trusses are either assembled off-site or they can be assembled on-site on the ground or they can be stick built in the final position. Assembled trusses are lifted into place and secured to the walls. Temporary bracing is often added to ensure the joist remains sufficiently stabilized and held in place during construction. Finally, permanent bracing is added to the bottom chords, webs, and to the top chords (if sheathing is not applied directly to the chord or if the sheathing that is applied is not sufficient to provide the bracing strength). A considerable amount of effort is required to cut, fit, and install every piece from the truss chords/webs, to the bracing elements in the final roof. Codes and safety standards are also being constantly updated demanding strict compliance to construction standards and greater worker safety on construction sites. On many roof structures the geometry is very complex, requiring a great deal of layout work to be carried out and the need for many alternative type of connector arrangements and parts. Mass-produced products are easy to manufacture but are by nature difficult to customize and they require custom detailing and design for each project.

Accordingly it would be advantageous to have a metal truss architecture that enables for customization from the 'point of sale', a structural design and order system developed for end user needs with easy-to-assemble parts that are mass-customized. A user's needs would be surpassed if the system architecture is developed to conduct estimating, design, detailing, roll-forming, truss assembly and erection using information technology to simplify all phases of the value stream. It would be advantageous to have a structural truss system wherein all aspects of the supply chain are taken into account for the design of manufactured parts. It would be advantageous to have a truss system that could be assembled in such a way that the number of fasteners can be reduced and the number of layers to pass fasteners through are reduced. Since all members in a truss must be assembled together it would be advantageous to have the parts produced with markings that identify technical and geometric information required for assembly.

Having an architecture based on mass-customization this invention reduces the amount of procurement time and labour involved in the pricing, design, drawing, manufacture, assembly and installation of light steel trusses for roof and floor construction. This invention has been developed to simplify the procurement and assembly of trusses: to reduce overall system manufacturing costs, to enhance worker safety and to reduce assembly time and costs.

SUMMARY OF THE INVENTION

One aspect of the present invention is directed to a truss chord for use in a light steel truss. The truss chord includes a flange portion, a pair of web portions and at least one wing. The flange portion has an end and an end portion. The end portion has a double thickness. The pair of web portions extend substantially orthogonally from the flange portion and are spaced inwardly from the ends of the flange portion. The at least one wing extends outwardly substantially orthogonally from at least one of the pair of web portions.

Another aspect of the invention is directed to a truss chord having at least one wing with a plurality of holes formed therein.

A further aspect of the invention is directed to a web chord.

Another aspect of the present invention is directed to a light steel truss comprising: a bottom chord being an elongate channel member having at least one wing extending outwardly from at least one end of the channel member; a top chord being an elongate channel member having at least one wing extending outwardly from at least one end of the channel member; a plurality of spaced apart bridging holes formed in the wings of one of the bottom chord wings and the top chord wings; a plurality of web members attached between the bottom chord and the top chord; and a plurality of modular connectors.

Another aspect is directed to a truss system that includes a plurality of the light steel trusses of the present invention.

A still further aspect of the invention is directed to a mass customization system for manufacturing the trusses.

Further features of the invention will be described or will become apparent in the course of the following detailed description.

BRIEF DESCRIPTION OF THE DRAWINGS

The invention will now be described by way of example only, with reference to the accompanying drawings, in which.

DETAILED DESCRIPTION OF THE INVENTION

Figure 2:
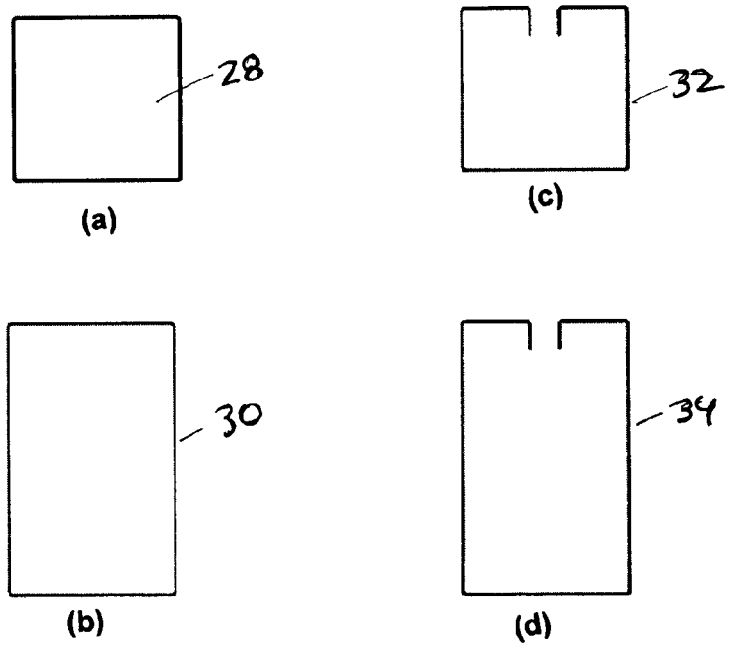
FIGURE 2 (PRIOR ART)
FIGS. 2 (*a*), (*b*), (*c*), and (*d*) are cross sectional views of prior art truss web members.
Figure 1:
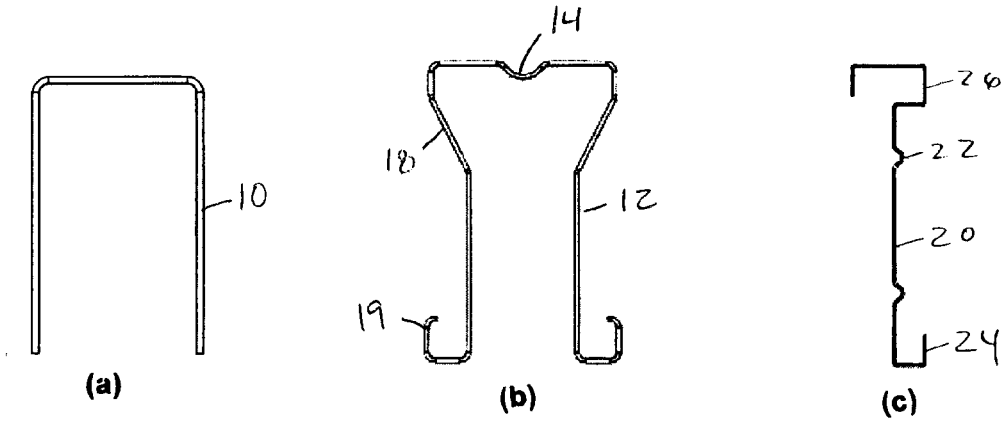
FIGURE 1 (PRIOR ART)
FIGS. 1 (*a*), (*b*) and (*c*) are cross sectional views of prior art truss chord members.

Referring to FIGS. 1 (*a*), (*b*) and (*c*) prior art truss chords are shown, wherein (a) is a simple U-shaped chord 10 with a lip; (b) is a more modified U-shaped chord 12 with a central detent 14, sloped side portions 18 and C-shaped lips 19; and (c) is a generally planar chord 20 with a ribs 22 an L-shaped lip 24 at one end and an open rectangular lip 26 at the other end. FIGS. 2 (*a*), (*b*), (*c*) and (*d*) show prior art truss webs for use with U-shaped chords, wherein (a) is a generally square tubular member 28; (b) is a generally rectangular tubular member 30; (c) is an open square shaped member 32 and (d) is an open rectangular shaped member 34.

Figure 3:
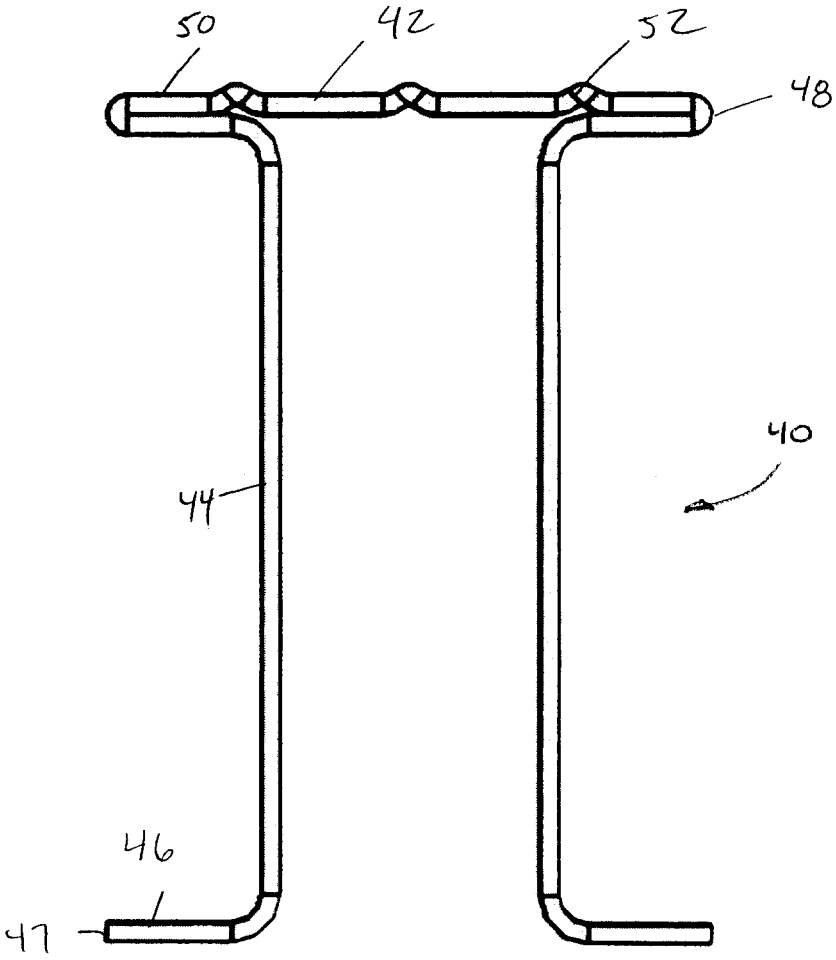
FIG. 3 is a cross sectional view of an embodiment of a truss chord member constructed in accordance with the present invention.

Referring to FIG. 3, an embodiment of a truss chord for use in the truss assembly of the present invention is shown generally at 40. Truss chord 40 has a flange portion 42, a pair of web portions 44 and a pair of wings 46 extending outwardly from respective flange portions. The web portions 44 are substantially orthogonal to the flange portion 42 and the wings 46 are substantially orthogonal to the flange portions 42. The end 47 of wings 46 are substantially in line with the end 48 of flange 42.

In the embodiment shown in FIG. 3, the web portion 44 is spaced inwardly from the ends 48 and the end portions 50 have double thickness. The Double flange end portions 50 perform well in compression and provide a surface for fastening. The flat surface of the web portion 44 provide a fastening and connecting surface. A plurality of longitudinal ribs 52 may be provided along the flange 42.

The step back of web members 44 from the ends of the flanges 42 and wings 46 facilitates connections of webs and secondary trusses at the same node. The connections are discussed in more detail below. Further, the configuration of the webs 44, flange 42 and wings 46 provide a substantially rectangular envelope. A slip-on connector may be provided that covers the envelope.

Figure 4:
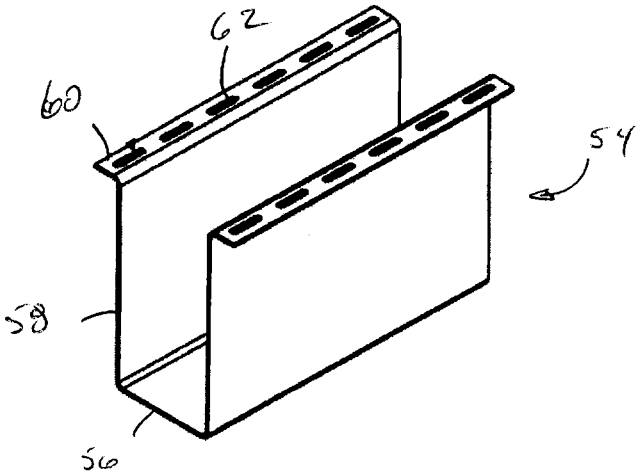
FIG. 4 is a perspective view of an embodiment of a truss chord member constructed in accordance with the present invention.

Alternate truss chord configurations are shown in FIGS. 4 to 9. Specifically, FIG. 4 shows a substantially U-shaped truss chord 54. Truss chord 54 has a flange 56, a pair of web portions 58 and a pair of wings 60. Each wing 60 has a plurality of spaced apart holes 62 formed therein. The holes 62 are positioned longitudinally along each wing 60. Holes 62 are provided to facilitate engagement of snap-in place bridging discussed in more detail below. It will be appreciated by those skilled in the art that all of the truss chord configuration may include similar wings with holes.

Figure 7:
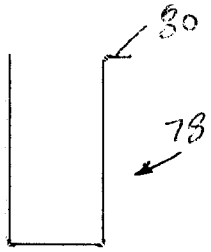
FIG. 7 is a cross sectional view of an alternate embodiment of a truss chord member constructed in accordance with the present invention.
Figure 8:
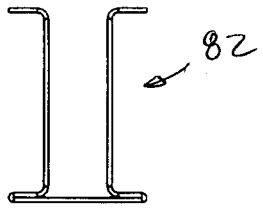
FIG. 8 is a cross sectional view of an alternate embodiment of a truss chord member constructed in accordance with the present invention.
Figure 9:
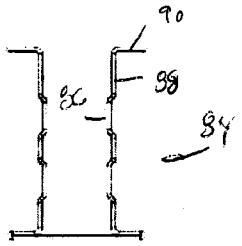
FIG. 9 is a cross sectional view of an alternate embodiment of a truss chord member constructed in accordance with the present invention.
Figure 5:
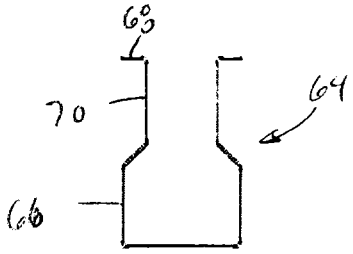
FIG. 5 is a cross sectional view of an alternate embodiment of a truss chord member constructed in accordance with the present invention.
Figure 6:
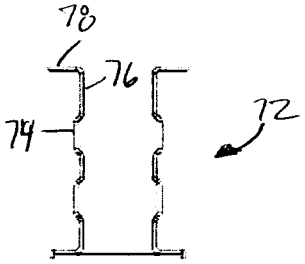
FIG. 6 is a cross sectional view of an alternate embodiment of a truss chord member constructed in accordance with the present invention.

FIG. 5 shows a substantially U-shaped member 64 with a box portion 66 and wings 68 extending from the web 70. FIG. 6 is a substantially U-shaped truss chord 72 similar to that shown in FIG. 3 but having embosses 74 on the web 76 which extend outwardly. Wings 68 extend outwardly from the web 76. FIG. 7 shows a substantially U-shaped truss chord 78 similar to that shown in FIG. 6 but showing a wing 80 extending from only one side of the chord. This configuration is particularly useful for an end wall. FIG. 8 shows a substantially U-shaped truss chord 82 similar to that shown in FIG. 3 but wherein the flange has a smooth surface. FIG. 9 is a substantially U-shaped truss chord 84 similar to that shown in FIG. 6 but having embosses 86 on the web 88 which extend outwardly. Wings 90 extend inwardly from the web 88.

Figure 10:
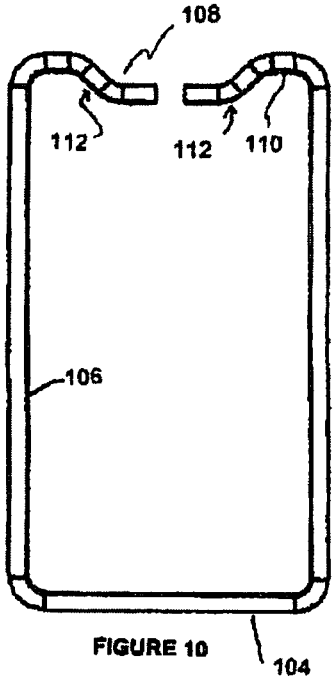
FIG. 10 is a cross sectional view of an embodiment of a truss web member constructed in accordance with the present invention.
Figure 11:
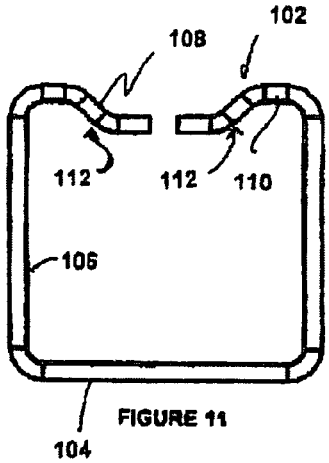
FIG. 11 is a cross sectional view of an alternate embodiment of a truss web member constructed in accordance with the present invention.

FIGS. 10 and 11 show a rectangular 100 and square 102 truss web respectively. The two configurations are essentially the same but for one being square and the other rectangular and accordingly the same numbering will be used for both. Truss webs 100 and 102 include an end 104, a pair of sides 106 and an opposed open end 108. Open end 108 includes a pair of arms 110 which extend inwardly from sides 106. Arms 110 include multi-cranked stiffeners 112. The multi-cranked stiffeners 112 function to increase the stiffness of the truss webs 100 and 102 such that these truss webs function almost to the specification of tube members but at considerably less cost to manufacture.

Figure 12:
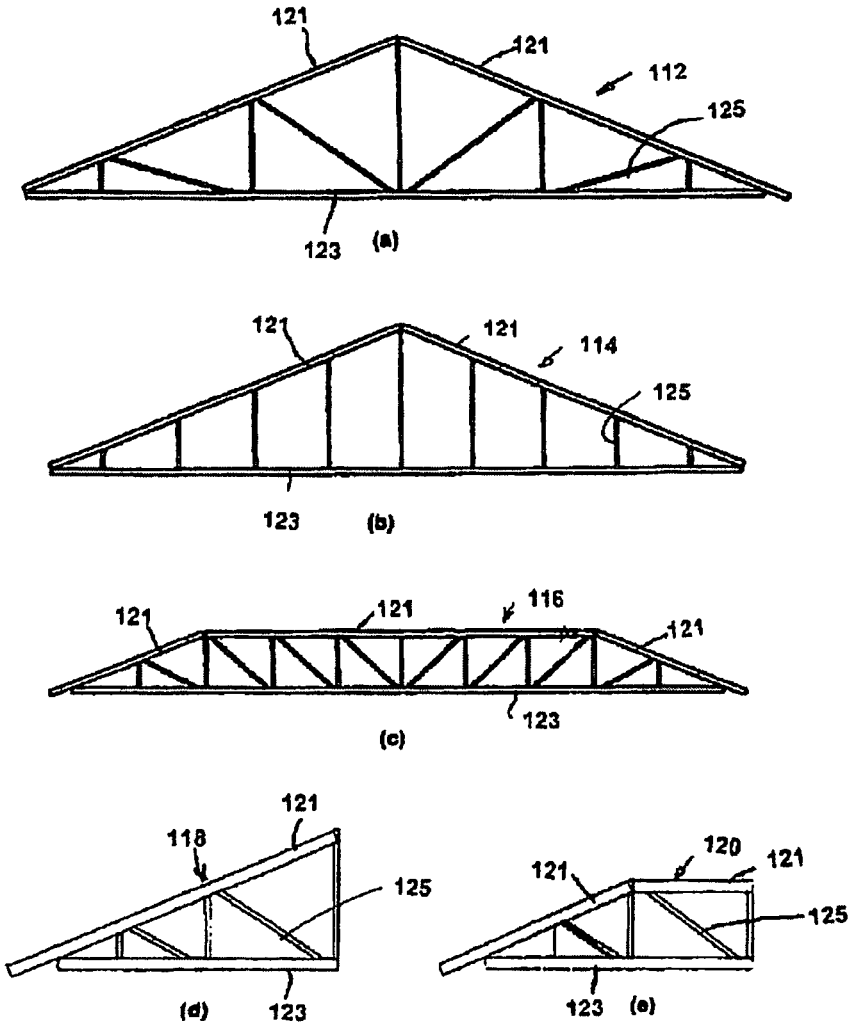
FIGS. 12 (*a*), (*b*), (*c*), (*d*) and (*e*) are cross sectional views of different truss types that may use the truss chord member and truss web member of the present invention.
Figure 13:
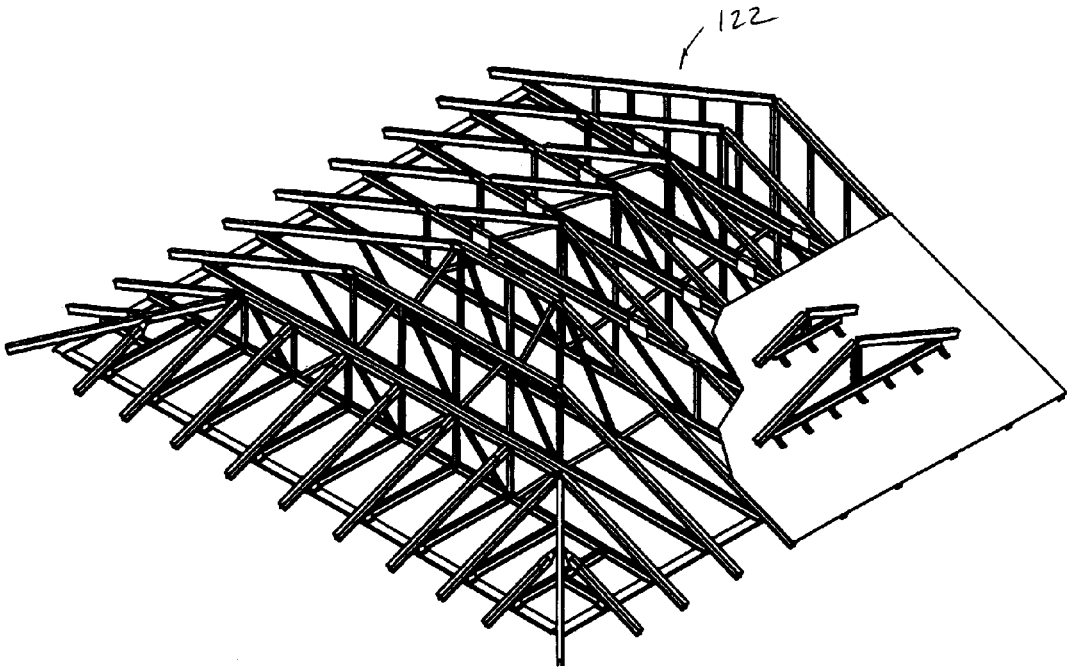
FIG. 13 is a perspective view of a truss system that may use the truss chord member and truss web member of the present invention.

The truss chords and truss webs described above may be used in a number of different types of trusses. Some examples of the types of trusses in which they may be used are shown in FIG. 12 wherein (a) is a double Howe truss 112, (b) a gable truss 114, (c) a hip truss 116, (d) a mono truss 118 and (e) a mono-hip truss 120. In turn these trusses may be used in a truss system an example of which is shown in FIG. 13. These trusses each include at least one top truss chord 121, a bottom truss chord 123 and a plurality of truss webs 125. The top truss chords 121 and bottom truss chords 123 may be any of those described above. The truss webs 125 may be any of those described above or prior art web members.

Examples of connectors for use in the trusses and truss systems are shown in FIGS. 14 to 37.

Figure 15:
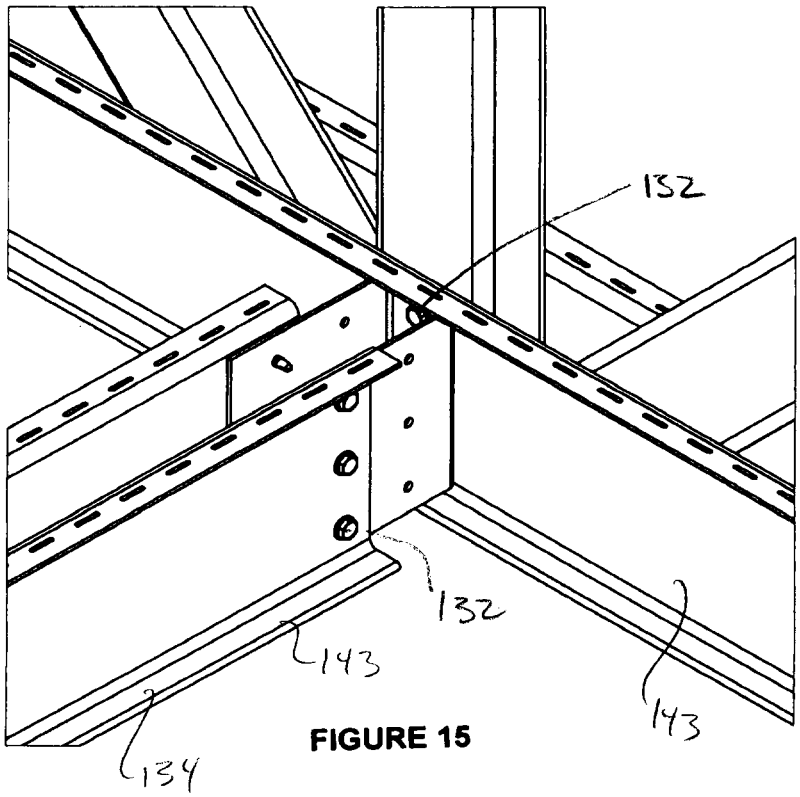
FIG. 15 is a perspective view of the inside connector assembly shown in FIG. 14 in use in a truss assembly.
Figure 14:
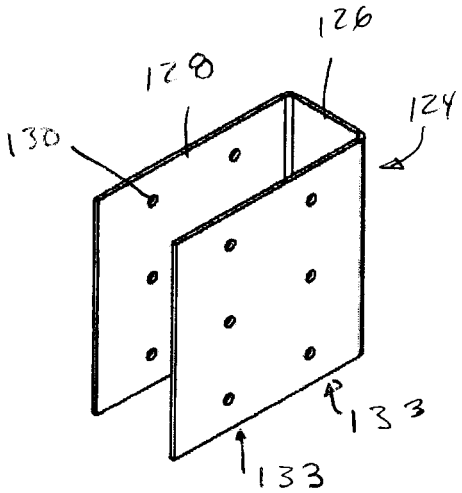
FIG. 14 is a perspective view of an insider connector assembly for use in a truss assembly of the present invention.
Figure 17:
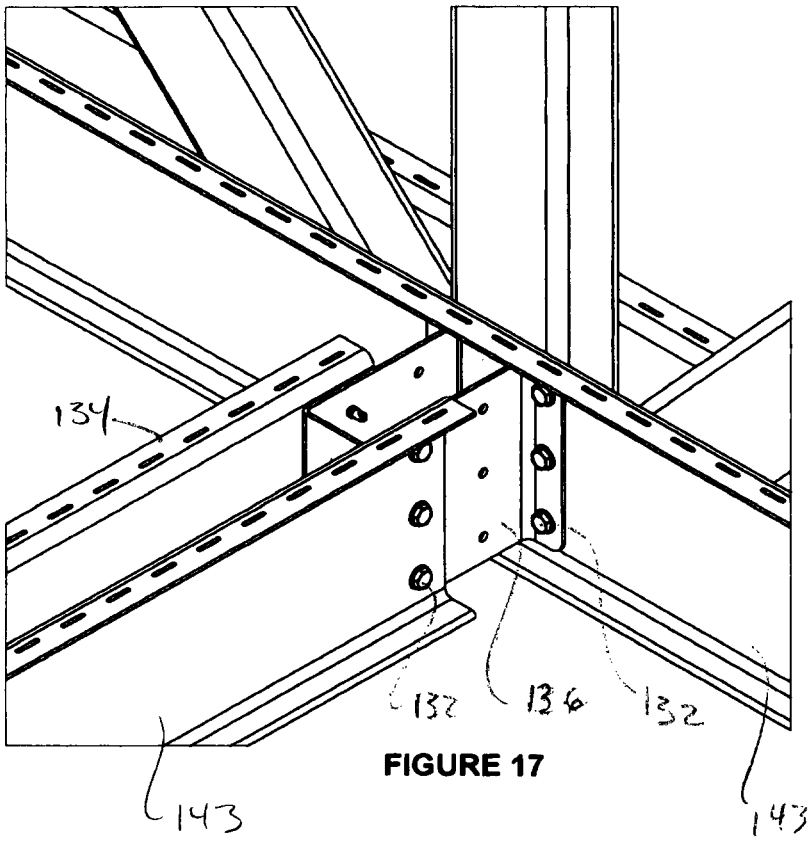
FIG. 17 is a perspective view of the outside connector assembly shown in FIG. 16 in use in a truss assembly.
Figure 16:
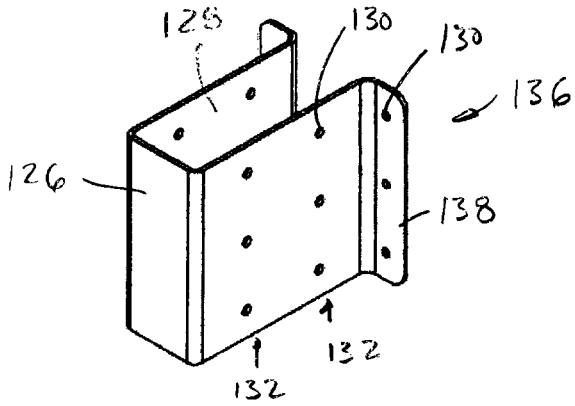
FIG. 16 is a perspective view of an outside connector assembly for use in a truss assembly of the present invention.

Referring to FIGS. 14 and 15 an insider connector assembly 124 is a substantially U-shaped member having an end portion 126 and side portions 128. Each is provided with a plurality of holes 130 for receiving screws 132. Preferably the side portion 128 have two sets 133 of spaced apart holes 130 such that in use the chord 134 may be attached to either set of holes 133. The outside connector assembly 136 is similar to connector 124 but it includes wings 138 which extend outwardly from side portions 128. It will be noted by those skilled in the art that the inside connector 124 uses fewer screws 132 in the connection. The outside connector 136 is particularly useful when multiple connections are being made at the same location.

Figure 19:
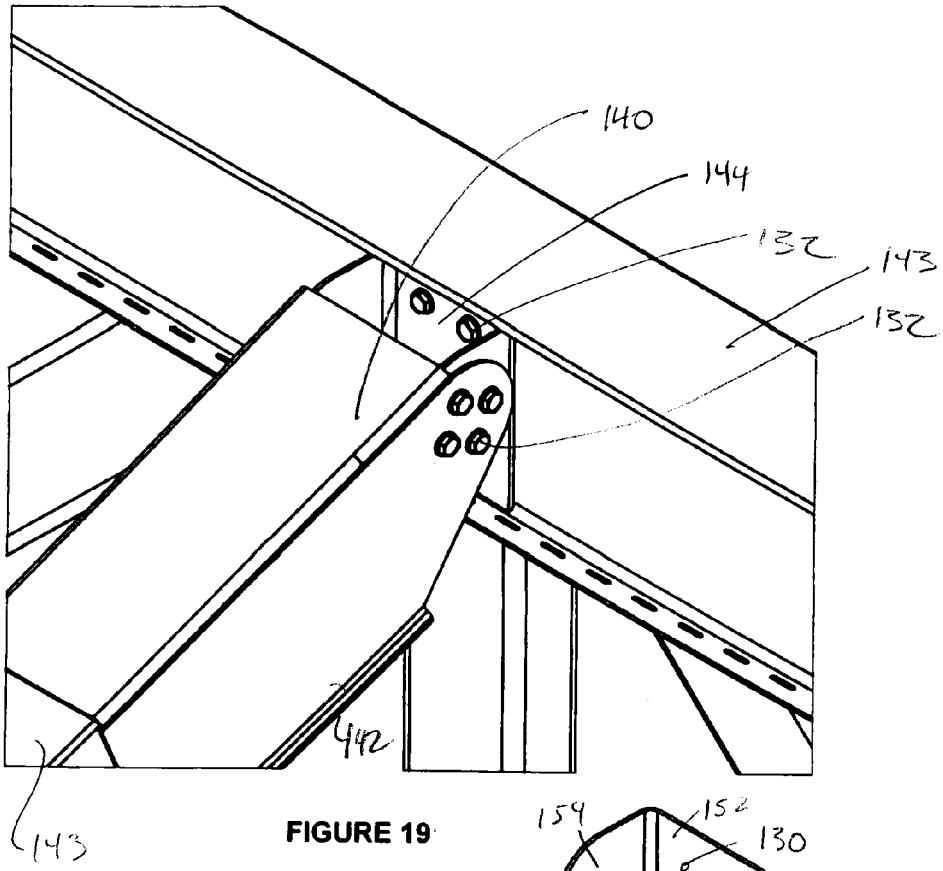
FIG. 19 is a perspective view of the sloped inside connector assembly shown in FIG. 18 in use in a truss assembly.
Figure 18:
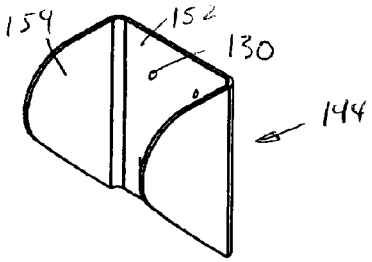
FIG. 18 is a blown apart perspective view of a sloped inside connector assembly for use in a truss assembly of the present invention.
Figure 18:
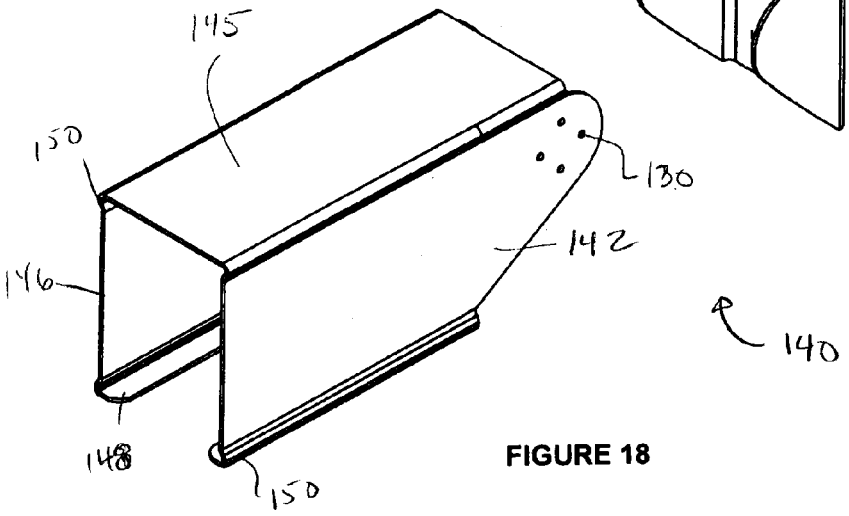
Figure 21:
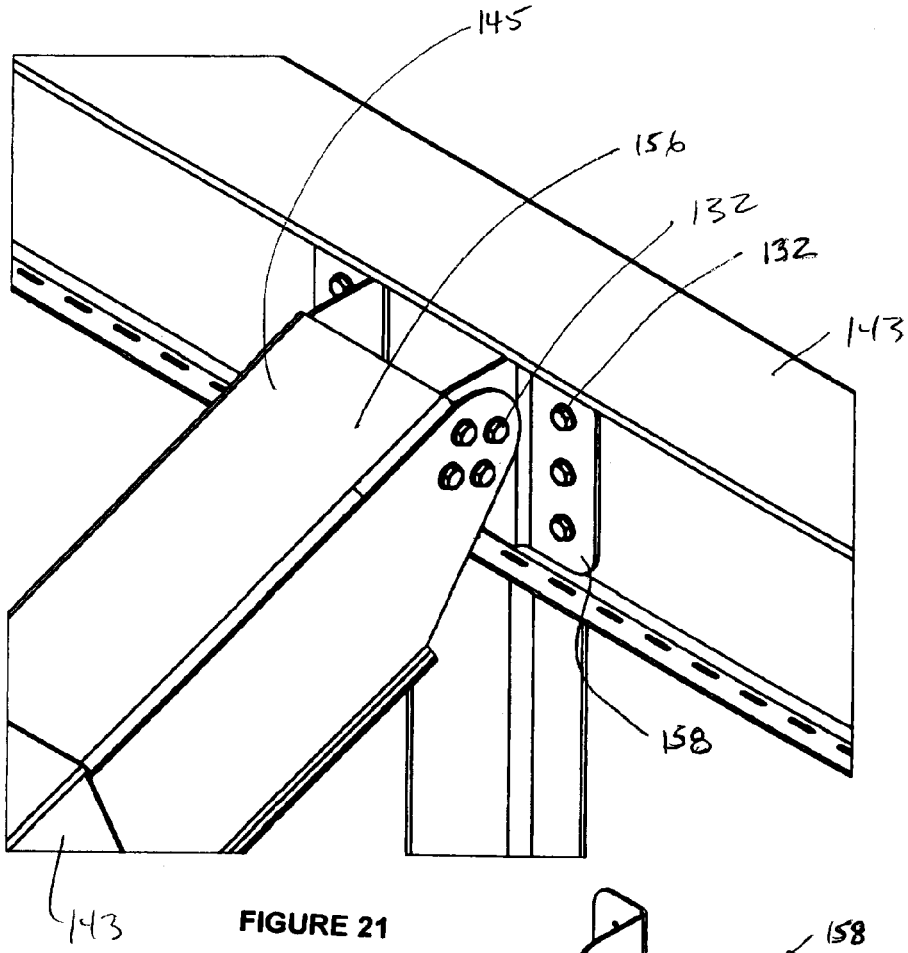
FIG. 21 is a perspective view of the sloped outside connector assembly shown in FIG. 20 in use in a truss assembly.
Figure 20:
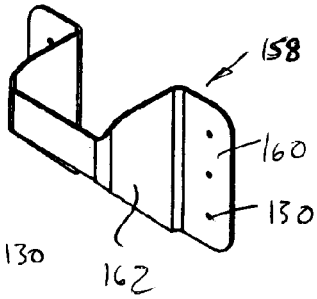
FIG. 20 is a blown apart perspective view of a sloped outside connector assembly for use in a truss assembly of the present invention.
Figure 20:
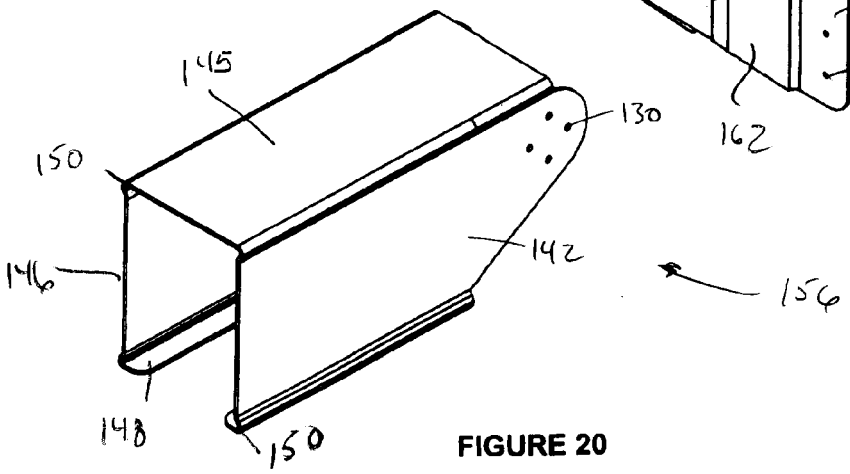

A sloped inside connector assembly 140 is shown in FIGS. 18 and 19. The sloped inside connector assembly 140 includes a slip on connector portion 142 and a web connection portion 144. Slip on connector portion 142 is a substantially U-shaped member that is adapted to be fit over a truss chord 143. It will be appreciated by those skilled in the art that these connectors may be used with different truss chords described above. Slip on connector portion 142 includes an end portion 145 and side portions 146. Lips 148 extend inwardly from side portions 146. Ribs 150 are provided at each corner. Web connection portion 144 includes an end portion 152 and side portions 154. Holes 130 are provided in the side portions 146 of slip on connector portion 142 and end portion 152 of web connection portion 144. Screws 132 attach web connection portion 144 to a truss chord 143 and screws 132 connect the slip on connection portion 142 to web connection portion 144. Referring to FIGS. 20 and 21, sloped outside connector assembly 156 is similar to sloped inside connector assembly 140 but the web connection portion 158 includes wings 160 extending outwardly from the side portion 162.

Figure 23:
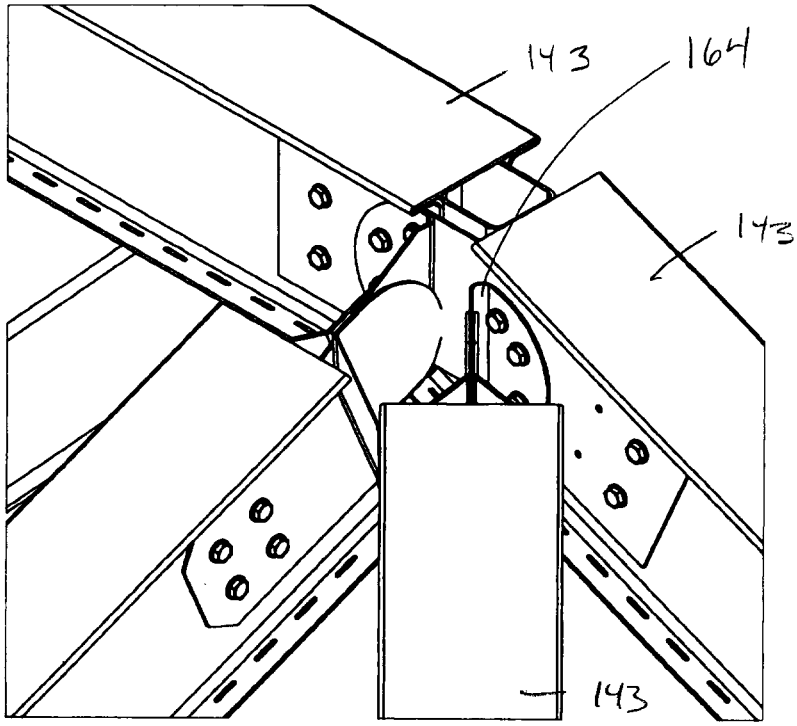
FIG. 23 is a perspective view of the inside compound sloped knuckle connector assembly shown in FIG. 22 in use in a truss assembly.
Figure 22:
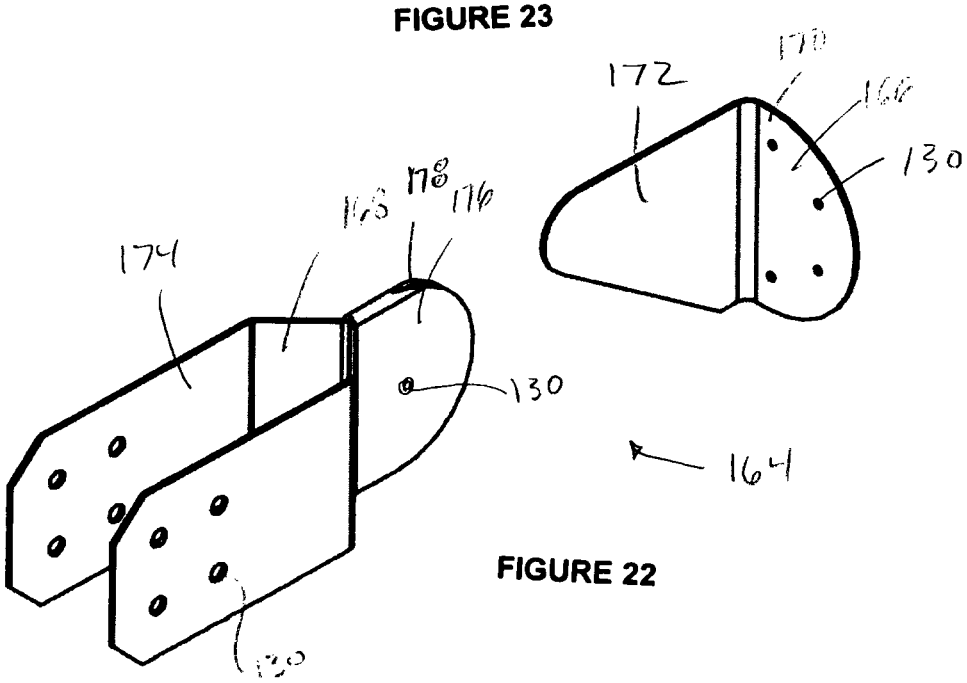
FIG. 22 is a blown apart perspective view of an inside compound sloped knuckle connector assembly for use in a truss assembly of the present invention.

An inside compound sloped knuckle connector assembly 164 shown in FIGS. 22 and 23 include an L-shaped connector portion 166 and a Y-shaped connector portion 168. L-shaped connector portion 166 has a first arm 170 and a second arm 172. The first arm 170 is adapted to be connected to the truss chord 143 and has a plurality of holes 130 provided therein. The Y-shaped connector portion 168 is attached to the second arm 172. The Y-shaped connector portion 168 includes a pair of spaced apart web arms 174 having holes 130 therein for attachment to a truss chord 143. Spaced apart web arms 174 are attached to a base 176. Base 176 has a slot 178 therein for receiving second arm 172 of L-shaped portion 166. L-shaped portion 166 is attached to a truss chord 143 and Y-shaped connector portion 168 is attached to L-shaped portion 166. Y-shaped connector portion 168 is attached to another truss chord.

Figure 25:
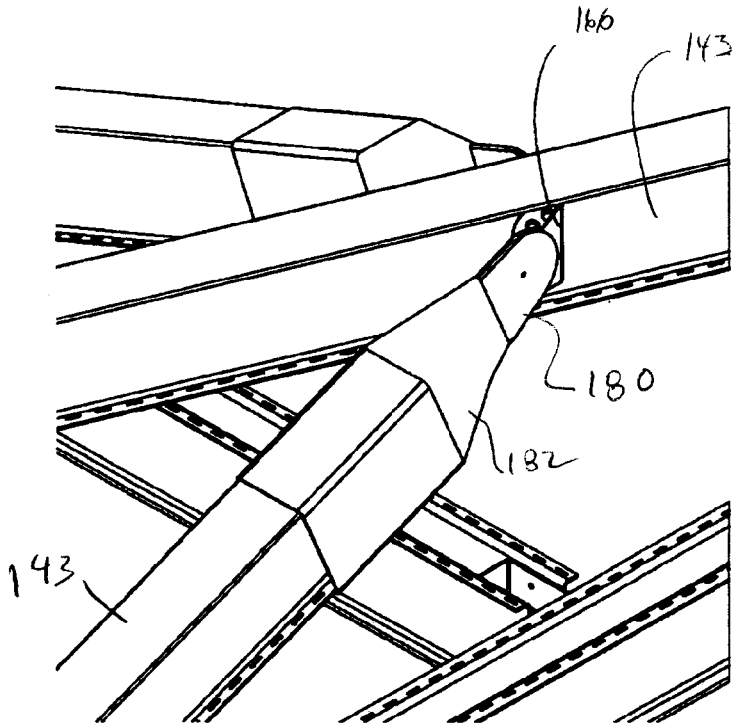
FIG. 25 is a perspective view of the outside compound sloped knuckle connector assembly shown in FIG. 24 in use in a truss assembly.
Figure 24:
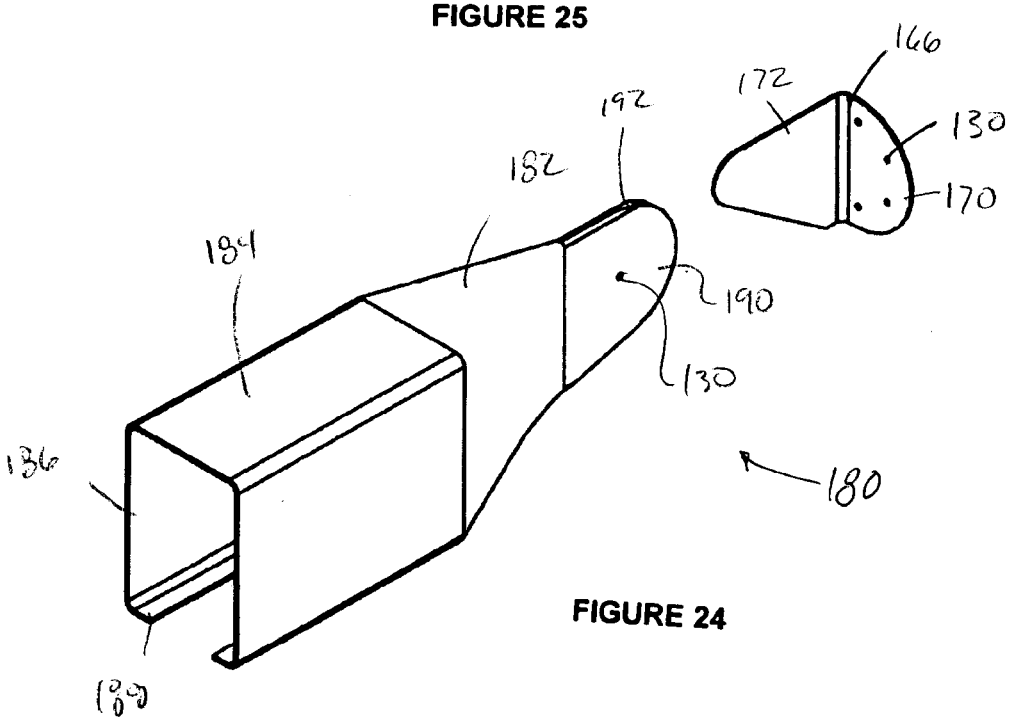
FIG. 24 is a blown apart perspective view of an outside compound sloped knuckle connector assembly for use in a truss assembly of the present invention.

An outside compound sloped knuckle connector assembly 180 shown in FIGS. 24 and 25 is similar to assembly 164 shown in FIGS. 22 and 23. Assembly 180 includes an L-shaped portion 166 and a slip on connector portion 182. Slip on connector portion 182 is a substantially U-shaped member that is adapted to be fit over a truss chord 143. Slip on connector portion 182 includes an end portion 184 and side portions 186. Lips 188 extend inwardly from side portions 186. A base 190 extends outwardly from connector portion 182. Base 190 includes a slot 192 for receiving second arm 172 of L-shaped connector 166. L-shaped connector 166 is attached to truss chord 143. Slip on connector is attached between L-shaped connector 166 and truss chord 143.

Figure 27:
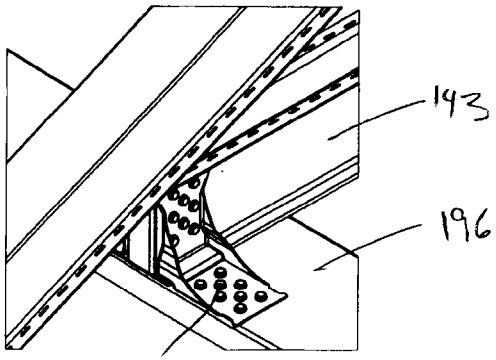
FIG. 27 is a perspective view of the uplift connector assembly shown in FIG. 26 in use in a truss assembly.
Figure 28:
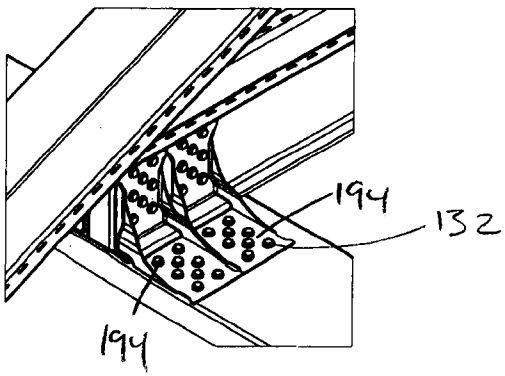
FIG. 28 is a perspective view of two uplift connector assemblies shown in FIG. 26 in use in a truss assembly.
Figure 26:
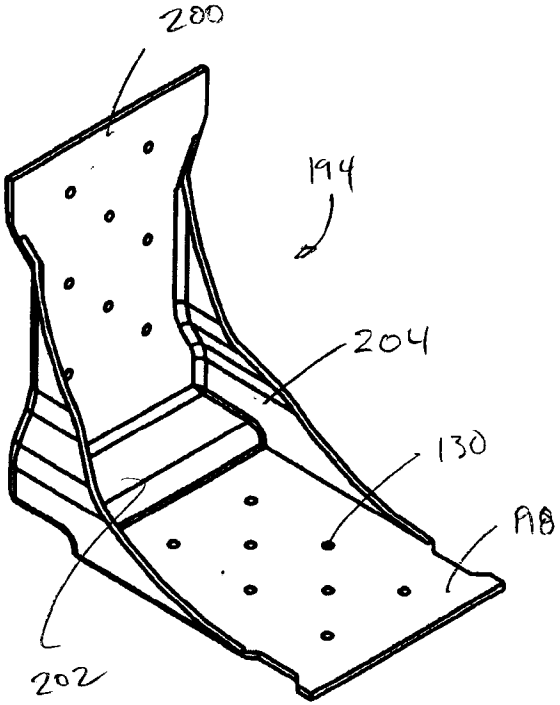
FIG. 26 is a perspective view of an uplift connector assembly for use in a truss assembly of the present invention.

Uplift connector 194 shown in FIGS. 26 to 28 is used to connect a truss chord 143 to the top of a wall 196. Uplift connector is a substantially L-shaped connector with a first arm 198 and a second arm 200. A step 202 is provided to accommodate the wings 46 of the truss chord. A pair of side braces 204 is provided between the first arm 198 and the second arm 200. A plurality of holes 130 are provided to receive screws 132. Uplift connectors 194 may be used singly as shown in FIG. 27 or doubled up as shown in FIG. 28 where there are higher loads.

Figure 30:
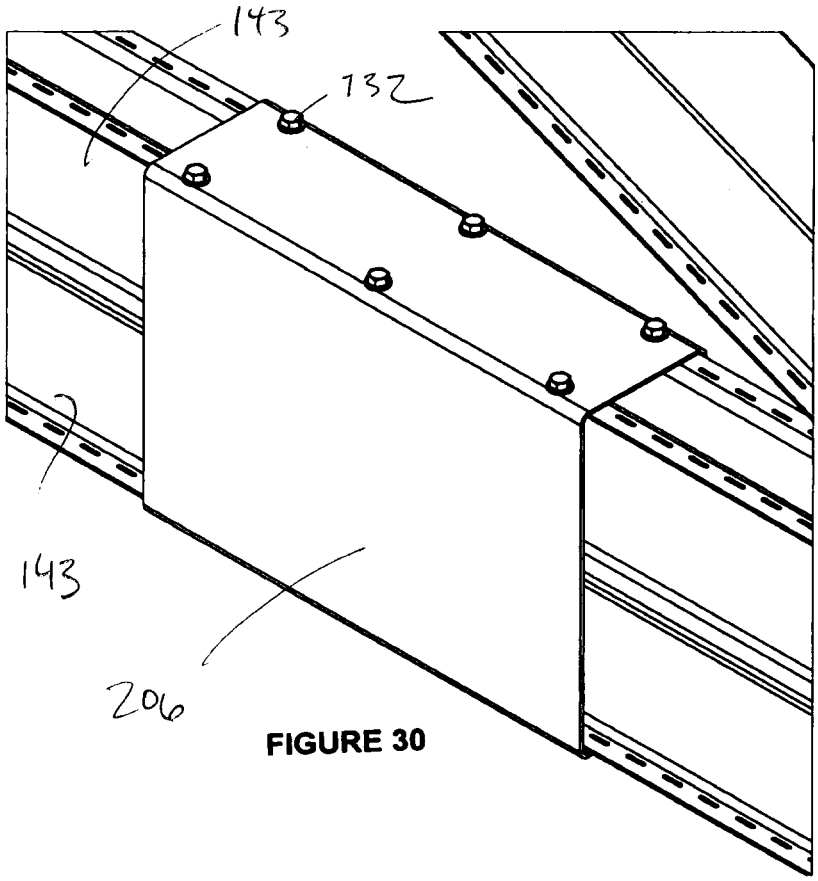
FIG. 30 is a perspective view of the truss piggy back connector assembly shown in FIG. 29 in use in a truss assembly.
Figure 29:
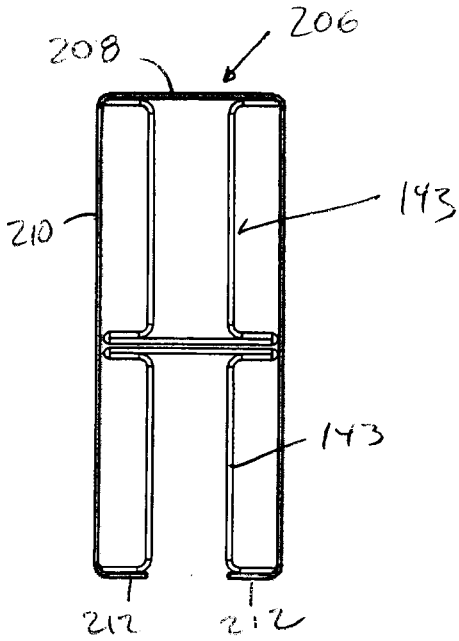
FIG. 29 is a perspective view of a truss piggy back connector assembly for use in a truss assembly of the present invention.
Figure 32:
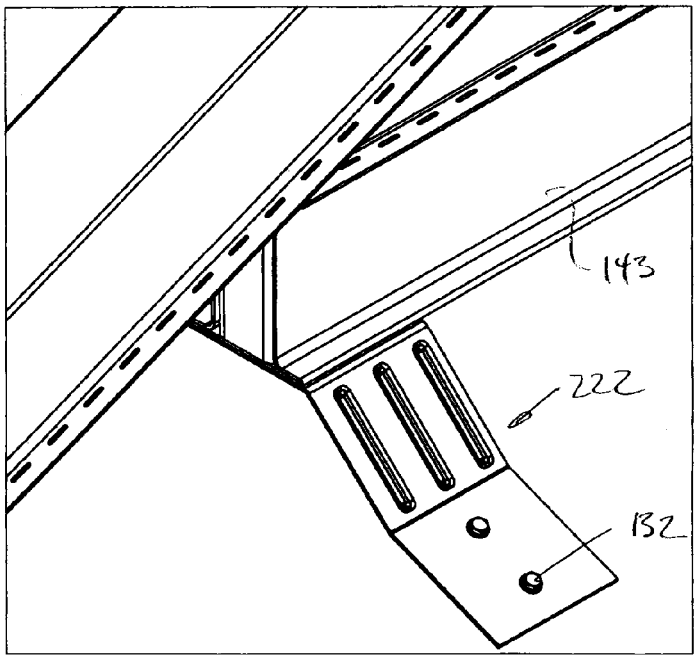
FIG. 32 is a perspective view of the truss valley connectors of FIG. 31 in use in a truss assembly.

A truss piggy back connector assembly 206 is shown in FIGS. 29 and 30. Connector 206 includes a top portion 208, side portions 210 and two bottom portion 212 extending inwardly from the side portions 210. Assembly 206 covers two truss chords 143 piggy backed on top of each other and is attached to the top chord with screws 132.

Figure 31:
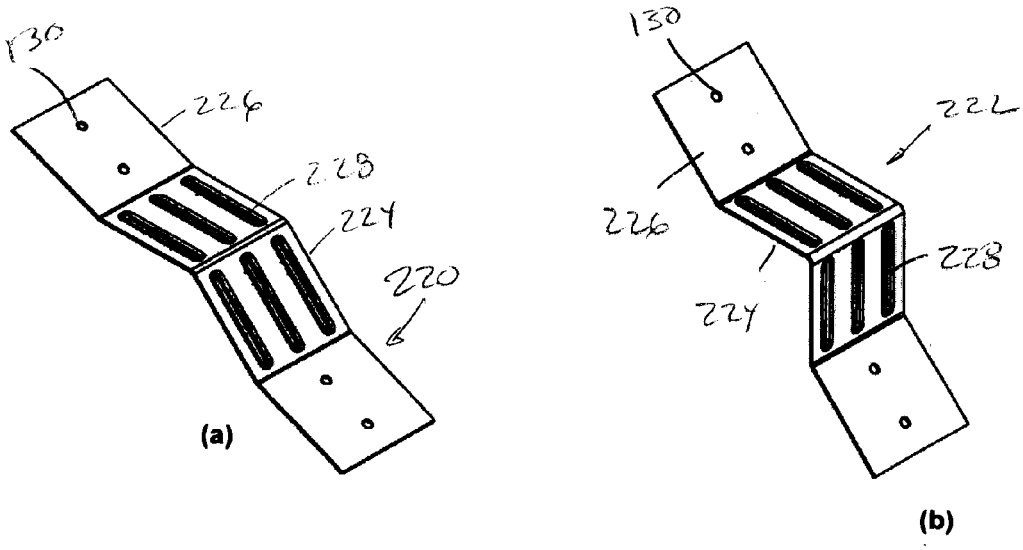
FIGS. 31 (*a*) and (*b*) are perspective views of truss valley connectors for use in a truss assembly of the present invention.

FIGS. 31 (*a*) and (*b*) show truss valley connectors 220 and 222 for a shallow and steep pitched roof respectively. Connectors 220 and 222 include a pair of pitch portions 224 and a pair of connector arms 226 extending therefrom. Holes 130 are provided to receive screws 132 to attach connectors 220 and 222 to truss chords 143. Pitch portions 224 are provided with a plurality of stiffening ribs 228.

Figure 34:
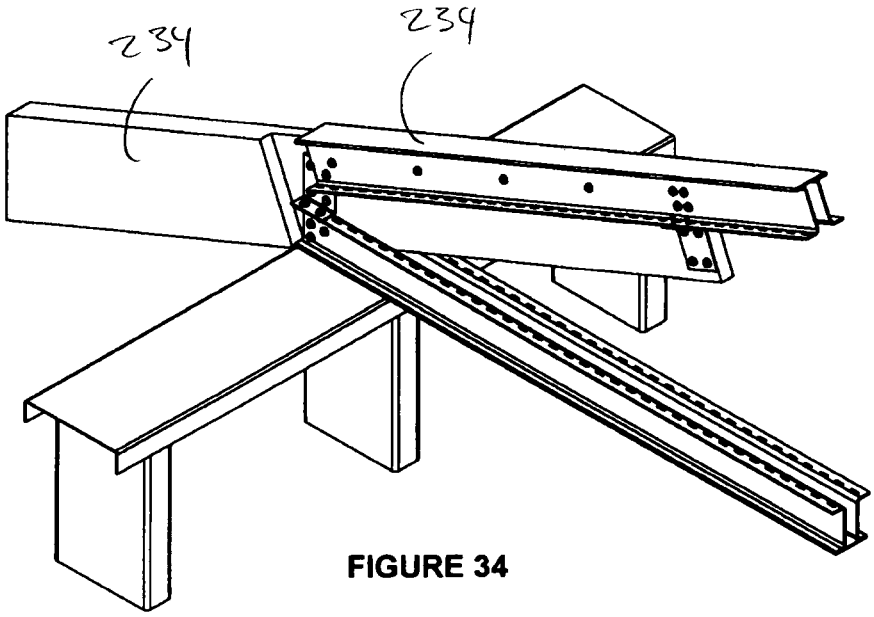
FIG. 34 is a perspective view of a wood eave detail of the truss assembly of the present invention.
Figure 33:
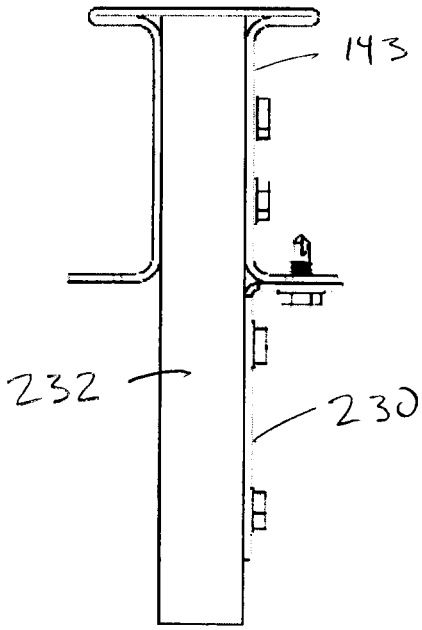
FIG. 33 is a cross sectional view of a stiffener added to a truss chord member of the present invention.
Figure 36:
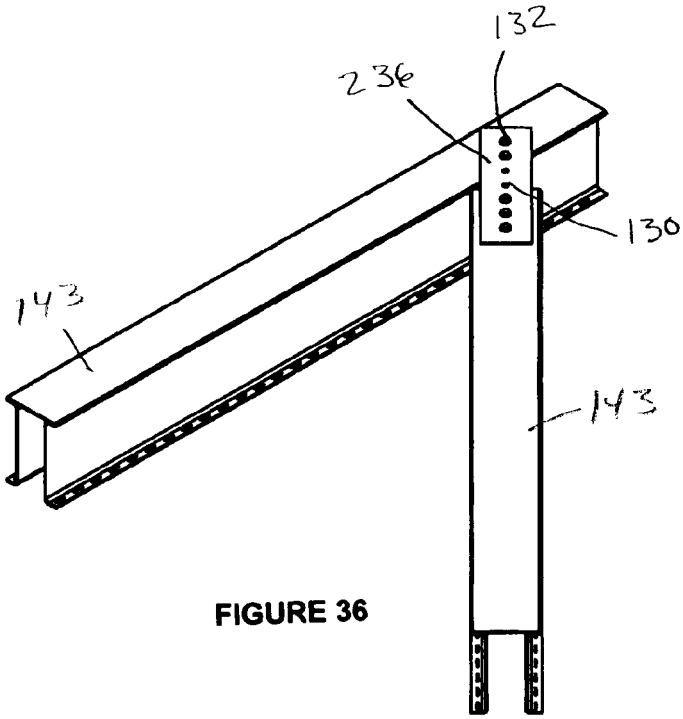
FIG. 36 is a perspective view of a plate connector similar to that shown in FIG. 35 but showing two truss chord members.
Figure 35:
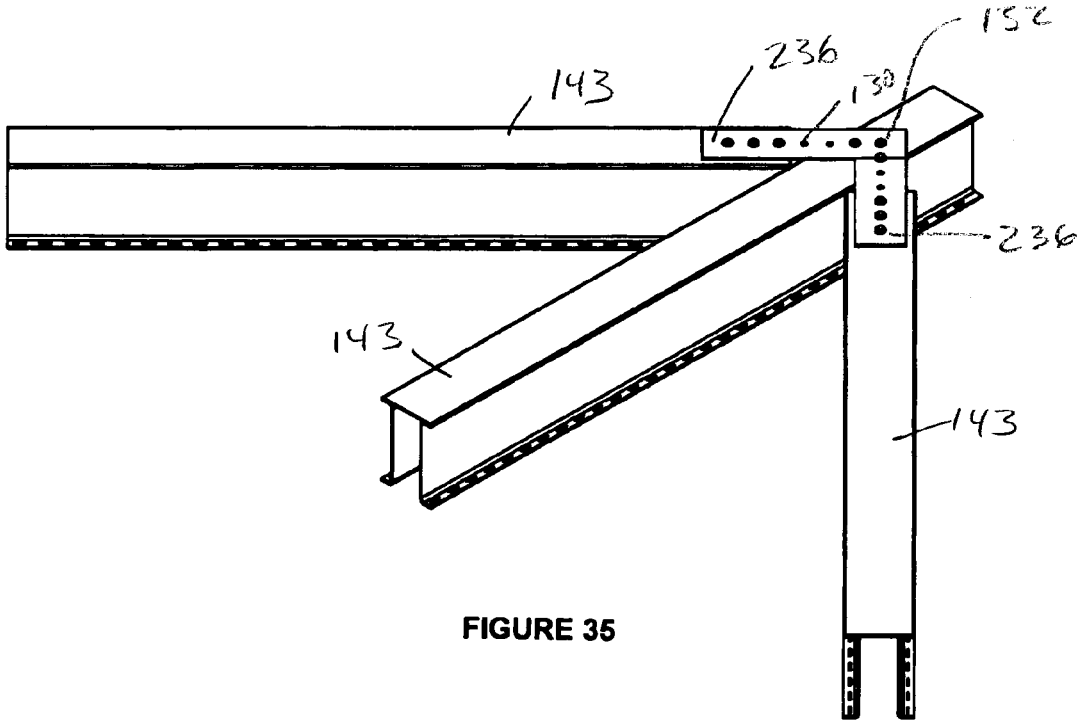
FIG. 35 is a perspective view of a plate connector connecting three truss chord members for use in the truss assembly of the present invention.

FIG. 33 shows a stiffener 230 added to a truss chord member 143. Plywood 232 may also be attached to truss chord member 143. FIG. 34 shows a wood eave 234 attached to a truss assembly 234. A plate 236 with a plurality of holes 130 formed therein may also be used to connect truss chords 143 as shown in FIGS. 35 and 36.

Figure 37:
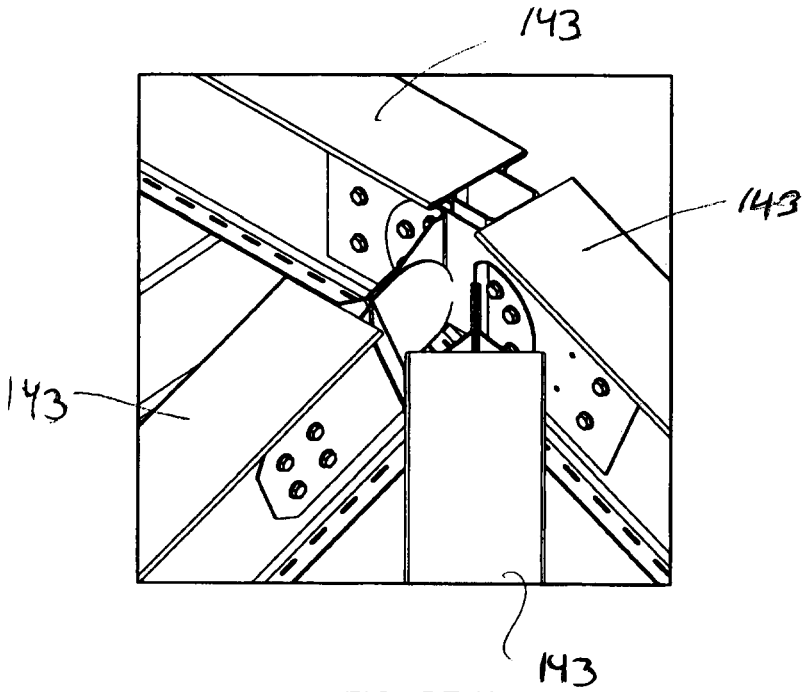
FIG. 37 is a perspective view of a five member connection in a truss assembly of the present invention.

It will be appreciated by those skilled in the art that with the connectors described above a plurality of truss chords 143 may be attached together to create a node as shown in FIG. 37.

Figure 38:
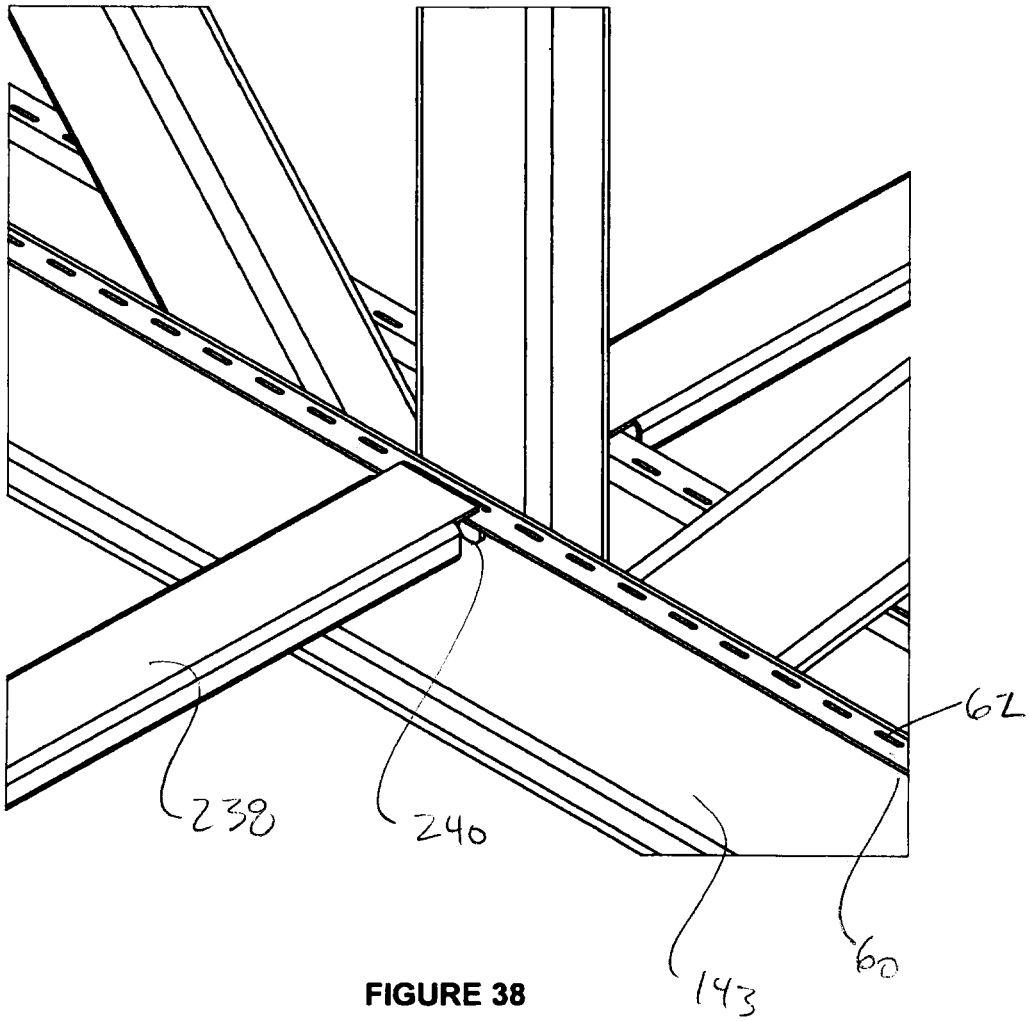
FIG. 38 is a perspective view of a bottom portion of a truss assembly showing it in use with snap in bridging.

The light steel trusses of the present invention are particularly useful in conjunction with snap in bracing members as shown in FIG. 38. The snap in bracing member 238 has fingers 240 extending downwardly which snap into the spaced apart holes 62 on the wings 60.

The trusses have pre-punched holes along the wings of the chord sections that accept snap-in bridging/bracing. The snap-in bridging/bracing can provide the temporary erection bracing required on both the top chord and the bottom chord to hold the trusses in place during construction. Since they are pre-planned and manufactured to length, the snap-in bridging/bracing provides for quicker truss installation because it aids the installer by aligning consecutive trusses with respect to the previous truss (spacing, plumb). Furthermore, the snap-in bridging also serves as permanent bracing of the top/bottom chord to prevent out-of-plane movement of the trusses elements during service loads. The snap-in bridging/bracing also makes installation of the bracing easier thus provides safer installation for the workers, and increases quality and consistency of construction.

Embodiments of this invention reduce the parts and fasteners required for truss to truss connections. Trusses are often framed into other trusses, such as a mono truss framing into a hip truss in a hip roof. However, roofs can have any prescribed slope. Furthermore, a single roof may have different slopes, such as on a hip where the intersecting roof slope is different than the slope of the hip. Currently, different connectors must be used to accomplish connections at different angles or multiple plates are used to connect the web of the mono truss to the web of the girder truss. Embodiments of this invention include variable angle connectors that can rotate to the required angle, connecting the mono truss to the girder truss at the intersection node. The connector can be used at the top and the bottom connecting, eliminating the need for multiple parts of different angles or multiple plates connecting the webs of the trusses. This not only reduces part configurations, but reduces on-site errors and labour since one part fits many conditions.

The snap-in bridging and connectors designed for alternative compound sloping conditions are the basis of this mass-customized truss system.

Figure 39:
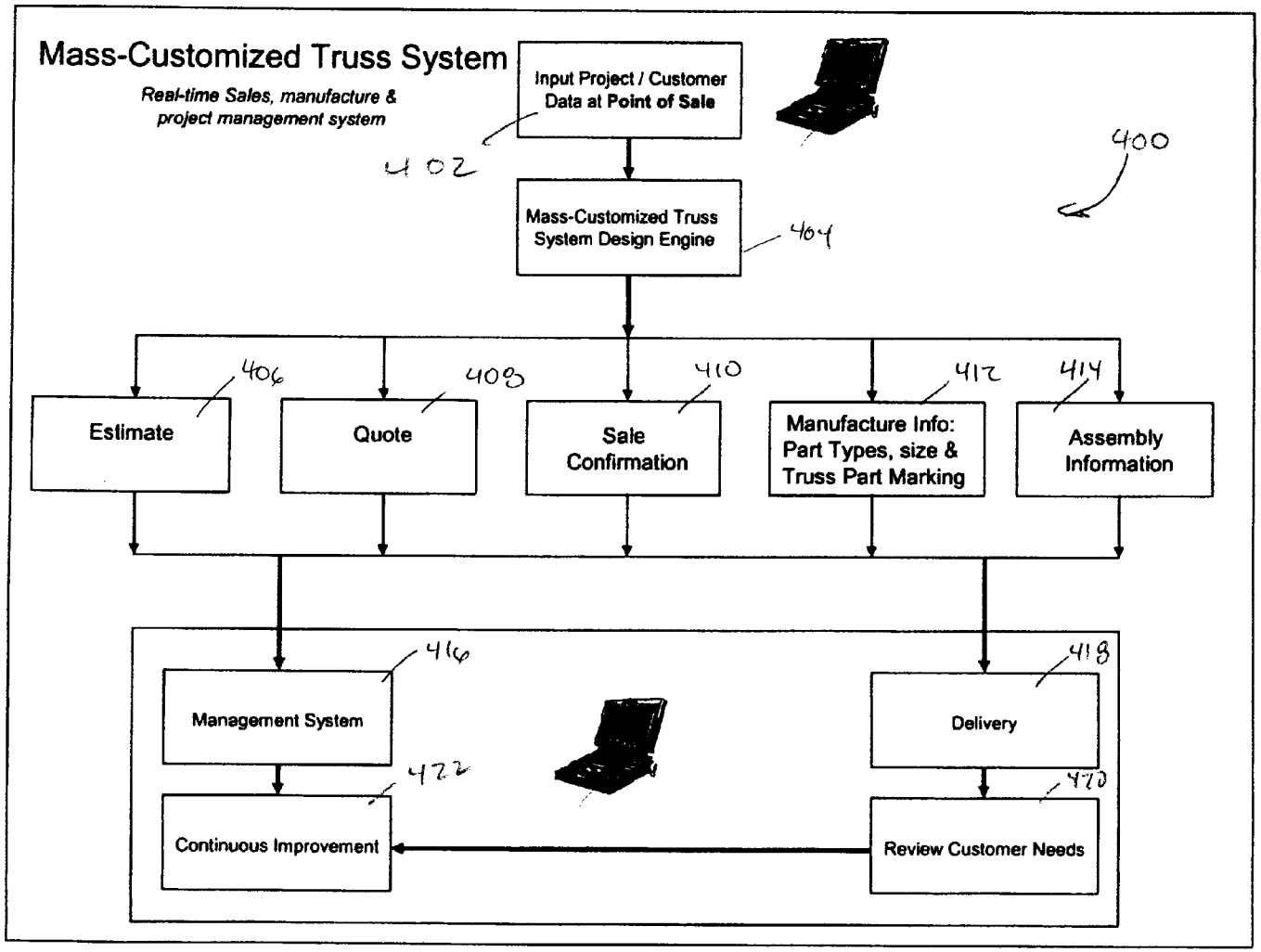
FIG. 39 is a flow chart of a mass customization system for use with the truss assembly of the present invention.

Embodiments of the trusses of this invention enable the delivery of highly customized parts using automated techniques that are possible by virtue of the fact that the system architecture has been developed using mass-customization techniques. This invention allows for delivery of customized Trusses and related procurement services at high volumes at low costs. The mass-customized truss system is shown generally at 400 in FIG. 39. The system 400 provides for real-time sales, manufacture & project management for the delivery of truss systems. Project/customer data is input at point of sale 402 to the mass-customized truss system design engine 404. The design engine determines an estimate 406; a quote 408; a sale confirmation 410; manufacture information 412 including part types, size and truss part; and marking assembly information 414. This information is sent to a management system 416 and the delivery chain 418. The delivery chain reviews the customer needs 420 and feeds information to continuous improvement system 422 as does the management system 416.

Figures 40, 41:
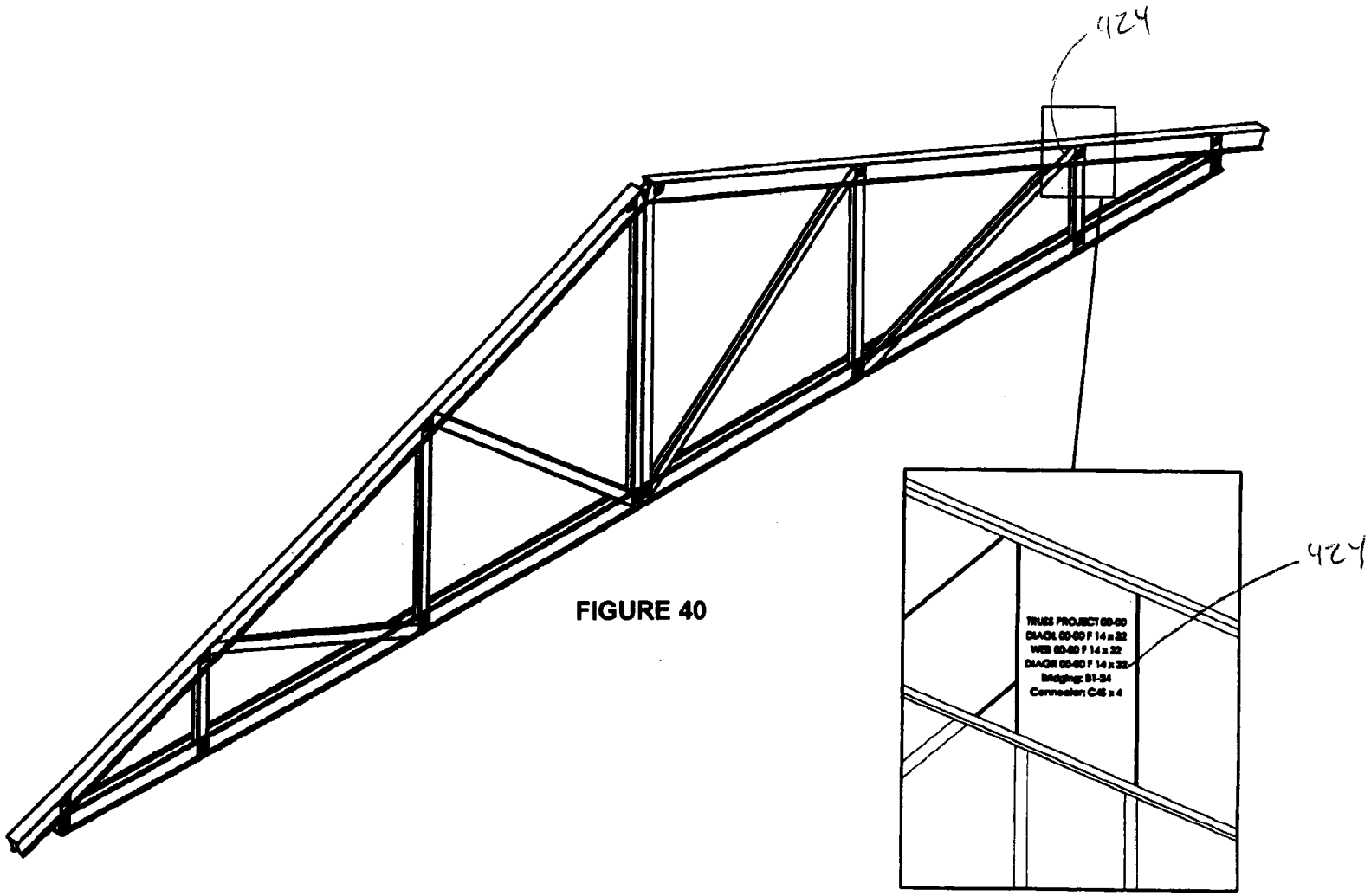
FIG. 40 is a perspective view of a truss assembled in accordance with the mass customization system of FIG. 39.
FIG. 41 is an enlarged perspective view of the marking used in the truss shown FIG. 40 for use in association with the mass customization system.

In order to facilitate truss assembly each truss member has project information 424 stamped onto the member as shown in FIGS. 40 and 41. This invention provides a truss system wherein the chords can be marked at each connection node during manufacture by means of ink or etching marks that indicate member locations, member types, supplementary connectors and fastener requirements. The mass-customized structural chord members have a flat web portion that facilitates marking and provides a flat surface for simple connector and fastener installation. This invention provides a paradigm shift in the metal truss market given all the assembly information is provided on the manufactured parts; this reduces the need to carry and handle drawings on site and provides a better means for joint completion verification and inspection.

Embodiments of this invention includes connectors that have been designed to snap in place and held sufficient to assist the worker that must also hold a screw gun and screws. Having connectors designed to assist the worker with assembly increases productivity and enhances worker safety.

Embodiments of the truss system of this invention have been developed using mass-customization techniques the chords, webs and connectors can be easily introduced to an information system that facilitates design, pricing, sales and manufacture from the point of sale.

Generally speaking, the systems described herein are directed to trusses, truss systems and a mass customization system therefor. As required, embodiments of the present invention are disclosed herein. However, the disclosed embodiments are merely exemplary, and it should be understood that the invention may be embodied in many various and alternative forms. The Figures are not to scale and some features may be exaggerated or minimized to show details of particular elements while related elements may have been eliminated to prevent obscuring novel aspects. Therefore, specific structural and functional details disclosed herein are not to be interpreted as limiting but merely as a basis for the claims and as a representative basis for teaching one skilled in the art to variously employ the present invention. For purposes of teaching and not limitation, the illustrated embodiments are directed to trusses, truss systems and a mass customization system therefore.

As used herein, the terms "comprises" and "comprising" are to construed as being inclusive and opened rather than exclusive. Specifically, when used in this specification including the claims, the terms "comprises" and "comprising" and variations thereof mean that the specified features, steps or components are included. The terms are not to be interpreted to exclude the presence of other features, steps or components.

What is claimed as the invention is:

1. A truss chord for use in a light steel truss comprising:

a flange portion having opposed ends and opposed end portions, each end portion including an overlapping portion creating a double thickness to provide strength in compression to the truss chord;

a pair of spaced apart web portions extending substantially orthogonally from the flange portion, the pair of web portions extending substantially parallel to each other along the lengths of the web portions, and spaced inwardly from the opposed ends of the flange portion, each of the web portions including a flat surface providing a fastening and connecting surface;

at least one wing extending outwardly substantially orthogonally from at least one of the pair of web portions and each wing having a plurality of spaced apart holes formed therein for receiving snap-in place bridging; and wherein the flange portion and web portions form a generally U-shaped cross-section and a substantially rectangular opening between the web portions.

2. A truss chord as claimed in claim 1 wherein the at least one wing is a pair of wings each extending from one of the pair of web portions.

3. A truss chord as claimed in claim 2 further including at least one elongate rib formed in the flange portion.

4. A truss chord as claimed in claim 3 wherein there are three elongate ribs.

5. A truss chord as claimed in claim 2 wherein the pair of web portions include embosses extending inwardly.

6. A truss chord as claimed in claim 2 wherein the pair of web portions include embosses extending outwardly.

7. A truss chord as claimed in claim 2 wherein each wing has an end and the end of each wing is substantially in line with a respective end of the flange portion.

* * * * *